United States Patent [19]

Martin et al.

[11] Patent Number: 4,488,942

[45] Date of Patent: Dec. 18, 1984

[54] ZINC AND ZINC ALLOY ELECTROPLATING BATH AND PROCESS

[75] Inventors: Sylvia Martin, Utica; R. Wilbur Herr, Troy, both of Mich.

[73] Assignee: OMI International Corporation, Warren, Mich.

[21] Appl. No.: 520,081

[22] Filed: Aug. 5, 1983

[51] Int. Cl.[3] ..... C25D 3/22; C25D 3/56

[52] U.S. Cl. ..... 204/44.2; 204/55 R

[58] Field of Search ..... 204/43 Z, 55 R, 43 T, 204/114, 123

[56] References Cited

U.S. PATENT DOCUMENTS 4,397,718 8/1983 Martin ..... 204/55 R
4,401,526 8/1983 Martin ..... 204/43 Z

FOREIGN PATENT DOCUMENTS 22528 2/1977 Japan ..... 204/55 R
729288 4/1980 U.S.S.R. ..... 204/43 Z

*Primary Examiner*—G. L. Kaplan
*Attorney, Agent, or Firm*—Richard P. Mueller

[57] ABSTRACT

An aqueous bath suitable for electrodepositing zinc and alloys of zinc including zinc-nickel, zinc-cobalt, zinc-nickel-cobalt, zinc-iron, zinc-iron-nickel, and zinc-iron-cobalt containing a brightening amount of an AB-type polyamide brightener in an amount effective to produce an electrodeposit of the desired brightness. The invention further contemplates the process of electrodepositing zinc and zinc alloys of the foregoing types on a conductive substrate employing the aqueous electrolyte.

27 Claims, No Drawings

ZINC AND ZINC ALLOY ELECTROPLATING BATH AND PROCESS

REFERENCE TO RELATED APPLICATIONS

The present invention relates generally to the subject matter of the following prior co-pending United States patent application: Ser. No. 381,090, filed May 24, 1982, entitled "Zinc Plating Baths With Condensation Polymer Brighteners", now U.S. Pat. Nos. 4,397,718; 381,089, filed May 24, 1982, entitled "Zinc Alloy Plating Baths With Condensation Polymer Brighteners", now U.S. Pat. Nos. 4,401,526; and 520,082, filed Aug. 5, 1983, entitled "Zinc/Iron Electroplating Bath and Process", now U.S. Pat. No. 4,444,629."

BACKGROUND OF THE INVENTION

The present invention broadly relates to an electroplating bath and process for electrodepositing zinc as well as alloys of zinc on a conductive substrate, and more particularly, to an electroplating bath and process incorporating controlled effective amounts of a bath soluble and compatible AB-type polyamide brightening agent for enhancing the characteristics of the zinc or zinc alloy electrodeposit.

Zinc and zinc alloy electroplating baths of various types have heretofore been used or proposed for use for depositing a metal plating of a decorative or functional type on a variety of conductive substrates such as iron and steel, for example, to provide for improved corrosion resistance, enhance the decorative appearance and/or to build up the surface of a worn part enabling refinishing thereof to restore its original operating dimensions. Typically, zinc as well as alloys of zinc and nickel, zinc and cobalt and zinc, nickel and cobalt can provide decorative surface finishes of a semi-bright to a lustrous appearance while simultaneously enhancing the resistance of the substrate to corrosion. Such electroplating baths in addition to plating baths for depositing a zinc and iron alloy, a zinc, iron and nickel alloy as well as a zinc, cobalt and iron alloy have found widespread commercial use for industrial or functional plating applications including strip plating, conduit plating, wire plating, rod plating, tube plating, coupling plating, and the like. Zinc electroplating baths can also be satisfactorily applied in processes such as electrowinning and zinc electrorefining while zinc alloys containing iron in the alloy deposit are suitable for electroforming of worn parts, for plating of soldering iron tips and for plating of Intaglio plates for printing and the like.

A problem associated with prior art zinc and zinc alloy electroplating baths has been the inability to employ a brightening agent which could be satisfactorily employed in all types of such zinc and zinc alloy electroplating baths. Additionally, such brightening additives have generally been limited to use over relatively narrow current density ranges and the electrodeposition of a zinc or zinc alloy plate of high ductility has been difficult to obtain when using any one brigthening additive.

In the prior copending United States patent applications, a brightening additive is disclosed which overcomes many of the problems and disadvantages associated with prior art brightening agents for zinc and zinc alloy plating in that the brightening additive can be used in a wide variety of types of zinc and zinc alloy plating over a broad pH and current density range to achieve a zinc or zinc alloy electrodeposit of the desired brightness and required ductility characteristics thereby providing for improved flexibility and versatility in the use of the bath and process. The present invention is similarly directed to an improved brigthening agent or mixtures of brightening agents which can be effectively employed in zinc and zinc alloy plating baths providing improved flexibility and versatility in the use and control thereof and in the electrodeposition of zinc and zinc alloy electrodeposits possessed of the desired appearance and physical properties.

SUMMARY OF THE INVENTION

The benefits and advantages of the present invention, in accordance with the composition aspects thereof, are achieved by an aqueous bath suitable for electrodepositing zinc and zinc alloys on a conductive substrate including zinc ions present in an amount sufficient to electrodeposit zinc and, in the case of a zinc alloy, one or more additional metal ions of the group including nickel, cobalt and iron present in an amount to electrodeposit an alloy of zinc and nickel, an alloy of zinc and cobalt, an alloy of zinc, nickel and cobalt; an alloy of zinc and iron, an alloy of zinc, iron and nickel; and an alloy of zinc, iron and cobalt. The bath further contains a brightening amount of an AB polyamide brigthener of the structural formula:

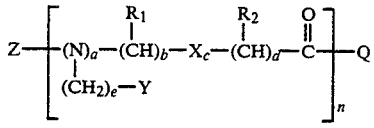

Z is —H, or

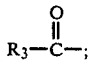

Q is —O—$R_4$,—$NR_5R_6$, or, —OM;

$R_1$ and $R_2$ are the same or different and are —H, —OH, an alkyl group of 1-4 carbons, an aryl group,

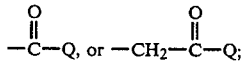

$R_3$ is

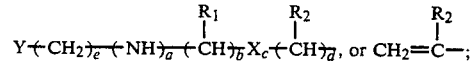

$R_4$, $R_5$ and $R_6$ are the same or different and are —H, or an alkyl, alkenyl, alkynyl, alkanol, alkenol, alkynol, keto alkyl, keto alkenyl, keto alkynyl, alkamine, alkoxy, polyalkoxyl, sulfoalkyl, carboxyalkyl, mercapto alkyl, or nitriloalkyl group having from 1 to about 12 carbon atoms, phenyl, or substituted phenyl, or,

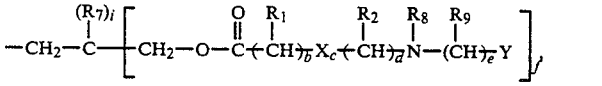

where f+i=3;

$R_7$ is —H, —OH, or a hydroxyalkyl group having from 1–4 carbons;

$R_8$ is —H, or an alkyl, alkanol, or alkamine group, having from 1–4 carbons, or

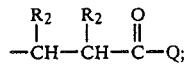

$R_9$, $R_{10}$ and $R_{11}$ are the same or different and are —H, or an alkyl group of 1–4 carbons;

$R_{12}$ is —H, or an alkanol, alkamine, sulfoalkyl, carboxyalkyl, hydroxyaryl, sulfoaryl, carboxyaryl, or aminoaryl having from 1 to about 10 carbons; or,

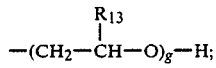

$R_{13}$ is —H, alkyl, alkenyl, or, alkynyl of 1–4 carbons or, $—CH_2—O—R_{14}$;

$R_{14}$ is —H, alkyl, alkenyl, or alkynyl of 1–4 carbons;

M is H, Li, Na, K, Be, Mg, or Ca;

X is

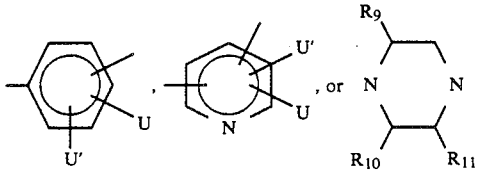

U and U′ are the same or different and are H, Cl, Br, F, $—NO_2$, $—SO_3M$, or, $—O—R_4$;

Y is $—O—R_{12}$, $—N(R_{12})_2$, $—SO_3M$, $—CO_2M$, $—SR_{12}$, —CN, or, Y′, except in the special case where:

b=c=O, and d=2, then Y is limited to being selected from the group defined for Y′;

Y′ is —H,

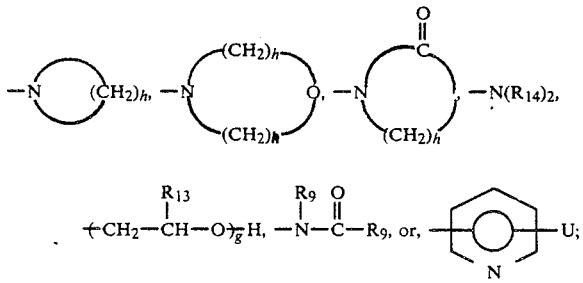

a is 0 or 1;

b is an integer from 0 to 11;

c is 0 or 1;

d is an integer from 0 to 2;

e is an integer from 0 to 6;

f is an integer from 1 to 3;

g is an integer from 1 to 30;

h is an integer from 2 to 5; and i is an integer from 0 to 2;

as well as mixtures thereof, wherein said constituents and the number thereof are selected so that the compound contains at least two amide groups.

The molecular weight of the AB-type polyamide brightener is not believed to be critical. The polyamide polymer must, however, be bath soluble which sets a functional upper limit of molecular weight or degree of polymerization. Thus, the molecular weight of the AB-type polyamide brightener can vary from that in which "n" in structural formula is 1 up to a molecular weight at which the brightener becomes bath insoluble.

The operating bath may range in pH from about 0 up to about 14 depending upon the specific type of bath employed as well as the particular alloy to be deposited. In the case of baths of a substantially neutral pH, the bath preferably further contains a complexing or chelating agent to retain an effective amount of the metal ions to be electrodeposited in solution. The baths further preferably contain bath soluble and compatible conductivity salts of the types conventionally employed to enhance the electrical conductivity of the bath. In zinc and zinc alloy baths for depositing a nickel and/or cobalt zinc alloy, the baths preferably further contain supplemental secondary brighteners and leveling agents as well as additives for improving the crystal structure of the electrodeposit. Buffering agents such as boric acid, for example, are also preferably included.

In accordance with the process aspects of the present invention, the electroplating bath of the foregoing composition is employed to electrodeposit zinc or a selected zinc alloy on a conductive substrate over a broad current density range with a bath temperature controlled within a prescribed range which will vary in consideration of the specific bath composition, method of electrodeposition and the particular alloy deposit and physical characteristics of the electrodeposit desired.

Additional benefits and advantages of the present invention will become apparent upon a reading of the Description of the Preferred Embodiments taken in conjunction with the specific examples provided.

DESCRIPTION OF THE PREFERRED EMBODIMENTS

The aqueous electroplating bath of the present invention for electrodepositing zinc and alloys of zinc contains a controlled amount of zinc ions and, in the case of the electrodeposition of a zinc alloy deposit, one or more additional metal ions selected from the group consisting of nickel, cobalt and iron in further combination with the novel AB-type polyamide brightener of the structural formula:

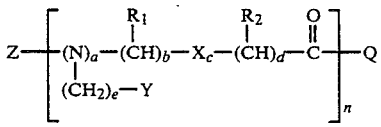

Z is —H, or

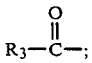

Q is $—O—R_4$, $—NR_5R_6$, or, —OM;

$R_1$ and $R_2$ are the same or different and are —H, —OH, an alkyl group of 1–4 carbons, an aryl group, $$-\overset{O}{\overset{\|}{C}}-Q, \text{ or } -CH_2-\overset{O}{\overset{\|}{C}}-Q;$$

$R_3$ is $$Y\text{-}(CH_2)_e\text{-}(NH)_a\text{-}(\overset{R_1}{\overset{|}{C}H})_b X_c\text{-}(\overset{R_2}{\overset{|}{C}H})_d, \text{ or } CH_2=\overset{R_2}{\overset{|}{C}}-;$$

$R_4$, $R_5$ and $R_6$ are the same or different and are —H, or an alkyl, alkenyl, alkynyl, alkanol, alkenol, alkynol, keto alkyl, keto alkenyl, keto alkynyl, alkamine, alkoxy, polyalkoxyl, sulfoalkyl, carboxyalkyl, mercapto alkyl, or nitriloalkyl group having from 1 to about 12 carbon atoms, phenyl, or substituted phenyl, or, $$-CH_2-\overset{(R_7)_i}{C}\left[CH_2-O-\overset{O}{\overset{\|}{C}}-(\overset{R_1}{\overset{|}{C}H})_b X_c-(\overset{R_2}{\overset{|}{C}H})_d N-(\overset{R_8}{\overset{|}{C}H})_e-\overset{R_9}{\overset{|}{C}}Y\right]_f$$

where $f+i=3$;

$R_7$ is —H, —OH, or a hydroxyalkyl group having from 1–4 carbons;

$R_8$ is —H, or an alkyl, alkanol, or alkamine group, having from 1–4 carbons, or $$-\overset{R_2}{\overset{|}{C}H}-\overset{R_2}{\overset{|}{C}H}-\overset{O}{\overset{\|}{C}}-Q;$$

$R_9$, $R_{10}$ and $R_{11}$ are the same or different and are —H, or an alkyl group of 1–4 carbons;

$R_{12}$ is —H, or an alkanol, alkamine, sulfoalkyl, carboxyalkyl, hydroxyaryl, sulfoaryl, carboxyaryl, or aminoaryl having from 1 to about 10 carbons; or, $$-(CH_2-\overset{R_{13}}{\overset{|}{C}H}-O)_g-H;$$

$R_{13}$ is —H, alkyl, alkenyl, or, alkynyl of 1–4 carbons or, $-CH_2-O-R_{14}$;

$R_{14}$ is —H, alkyl, alkenyl, or alkynyl of 1–4 carbons;

M is H, Li, Na, K, Be, Mg, or Ca;

X is

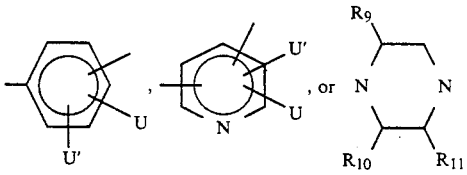

U and U' are the same or different and are H, Cl, Br, F, $-NO_2$, $-SO_3M$, or, $-O-R_4$;

Y is $-O-R_{12}$, $-N(R_{12})_2$, $-SO_3M$, $-CO_2M$, $-SR_{12}$, —CN, or, Y', except in the special case where:

b=c=O, and d=2, then Y is limited to being selected from the group defined for Y';

Y' is —H,

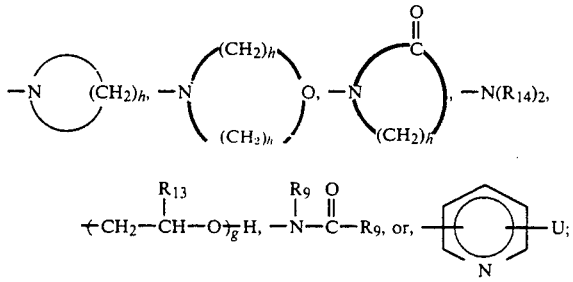

a is 0 or 1;

b is an integer from 0 to 11;

c is 0 or 1;

d is an integer from 0 to 2;

e is an integer from 0 to 6;

f is an integer from 1 to 3;

g is an integer from 1 to 30;

h is an integer from 2 to 5; and i is an integer from 0 to 2; as well as mixtures thereof, wherein said constituents and the number thereof are selected so that the compound contains at least two amide groups.

The molecular weight of the AB-type polyamide brightener is not believed to be critical. The polyamide polymer must, however, be bath soluble which sets a functional upper limit of molecular weight or degree of polymerization. Thus, the molecular weight of the AB-type polyamide brightener can vary from that in which "n" in structural formula is 1 up to a molecular weight at which the brigthener becomes bath insoluble.

AB-type polyamides corresponding to the foregoing structural formula can be be synthesized by a variety of well-known methods such as disclosed in the following references:

Melvin I. Kohan, Chapter 2, "Preparation and Chemistry of Nylon Plastics", in "Nylon Plastics", edited by Melvin I. Kohan, Interscience, 1973.

Richard E. Putscher, "Polyamides (General)", in "Kirk-Othmer, Encyclopedia of Chemical Technology", Third Edition, Vol. 18, pp. 328–371, Wiley-Interscience, 1982.

Stanley R. Sandler and Wolf Karo, Chapter 4, "Polyamides", in "Polymer Syntheses", Vol. I, pp. 88–115, Academic Press, 1974.

W. Sweeny and J. Zimmerman, "Polyamides", in "Encyclopedia of Polymer Science and Technology", Vol. 10, pp. 483–597, Interscience, 1969.

The brightener additives may be obtained commercially by modification of commercially available AB-type polyamides or by a polymerization reaction of the appropriate monomer. Both synthetic approaches are disclosed in the foregoing references.

In addition to the zinc ions and any other metal ions present in further combination with the AB-type polyamide brightening agent, the electroplating bath further contains as an optional but preferred ingredient, conventional bath soluble and compatible conductivity salts including ammonium sulfate, ammonium chloride, ammonium bromide, sodium chloride, potassium chloride, ammonium fluoroborate, magnesium sulfate, sodium sulfate, and the like to increase the electrical conductivity of the bath. Additionally, the electroplating baths contain various conventional buffering agents such as boric acid, acetic acid, benzoic acid, salicylic acid, ammonium sulfate, sodium acetate, and the like. The electroplating baths further contain appropriate concentrations of hydrogen ions and hydroxyl ions to provide an appropriate acidic, substantially neutral or an alkaline bath as may be desired and as subsequently described in further detail.

ZINC ELECTROPLATING BATH

Suitable electroplating baths for depositing decorative and industrial or functional platings consisting essentially of zinc can be formulated as an acid bath (pH about 0 to about 6), an alkaline bath (pH about 9 to about 14) and a substantially neutral bath (pH about 6 to about 9). Acid zinc plating baths can be formulated in accordance with conventional practice by introducing a zinc salt such as a sulfate, sulfamate or chloride in an aqueous solution along with a noncomplexing acid such as sulfuric acid, hydrochloric acid or sulfamic acid. Mixtures of zinc salts, for example, zinc sulfate and zinc chloride can be employed if desired. Acid zinc plating baths can also be based on zinc fluoroborate.

Acid zinc electroplating baths can also contain various other additives or agents. In some cases, a particular additive or agent may be useful for more than one purpose. Examples of such optional additional ingredients which can be employed include buffers and bath modifiers such as boric acid, acetic acid, benzoic acid, salicylic acid, ammonium chloride and the like. Carriers, such as polyoxylated alkanols, hydroxyaryl compounds, acetylenic glycols or sulfonated naphthalene derivatives can be used. Aromatic carbonyl compounds or nicotinate quaternaries may also be used to enhance leveling and brightness. Additional additives such as aluminum sulfate, dextrin, licorice, glucose, polyacrylamides, thiourea and derivatives thereof and the like may also be included in the bath to improve the crystal structure of the zinc electrodeposit obtained and to provide for a wider operating current density range.

Alkaline cyanide-free zinc baths are usually formed from a zinc salt such as an oxide or sulfate salt and a strong base such as sodium or potassium hydroxide. The predominant zinc species in the bath at high pH ranges is the zincate anion. It will be appreciated that as used herein, the term "zinc ion" includes zincate or other ionic species of zinc useful in electroplating baths for electroplating metallic zinc therefrom. Cyanide containing alkaline baths are usually formed from a zinc salt such as zinc oxide, a strong base such as sodium or potassium hydroxide, and varying amounts of sodium or potassium cyanide. Both cyanide-containing and cyanide-free, alkaline baths are well known in the art and have been commonly used for years.

In addition to the above mentioned ingredients, alkaline zinc plating baths may contain various additional ingredients. For example, alkaline zinc plating baths may contain buffers such as sodium or potassium carbonates. Also, aromatic aldehydes, nicotinate quaternaries, polyvinyl alcohol, or gelatine may be added to the baths for various purposes as is well known in the art.

The pH of the various zinc electroplating baths can be adjusted by the addition of a suitable agent such as the parent acid of the zinc salt in the bath, ammonium hydroxide, sodium or potassium carbonate, zinc carbonate, sodium or potassium hydroxide, boric acid or the like.

The concentration of the zinc ions in the bath can vary in accordance with conventional prior art practices. Generally, the zinc ion concentration can range from about 4 up to about 250 g/l with concentrations of about 8 to about 165 g/l being preferred. For acid zinc electroplating baths at a pH of about 0 to about 6, zinc ion concentrations of about 60 to about 165 g/l are preferred. For alkaline zinc electroplating baths at a pH of about 9 to about 14, a zinc ion concentration of about 8 to about 11 g/l is preferred. For neutral zinc electroplating baths, at a pH of about 6 to about 9, a zinc ion concentration ranging from about 30 to about 50 g/l is preferred. When neutral zinc electroplating baths are employed, it is preferred to incorporate one or a combination of complexing or chelating agents in a concentration sufficient to maintain an effective amount of zinc ions in solution to provide a desired deposit. Such chelating agents may comprise any of the types conventionally employed including acids such as citric, gluconic, glucoheptonoic, tartaric as well as the alkali metal, ammonium, zinc and other bath soluble and compatible salts thereof. Triethanolamine can also be employed.

The AB-type polyamide brightener can be employed over a broad range of concentrations ranging up to a maximum corresponding to the limit of its solubility in the electroplating bath. The minimum concentration will vary depending upon the specific additive and related factors such as the current density of the plating process employed. Generally speaking, the brightener is employed at a concentration sufficient to obtain the brightening effect desired. For most common purposes, the brightening additive will be present in the bath at a concentration from about 0.015 to about 2 g/l. However, at very low current density rates, the additive can be effective in very small amounts such as, for example, at 0.1 mg/l and at very high current density rates at concentrations as high as 10 g/l.

In accordance with the method of the present invention, a zinc deposit is electrodeposited from a zinc electroplating bath comprising the above described brightening additive in an amount effective to obtain a desirable zinc deposit. The process of zinc plating of the present invention is useful for decorative or industrial zinc plating such as electrowinning, electrorefining, strip plating, conduit plating, wire plating, rod plating, tube or coupling plating, and so forth. Each application will require a specific form of electrolyte to be used.

The electrodeposition of zinc from the bath is carried out in the older conventional or newer high speed functional methods with cathode current densities of 100–2000 amp/ft$^2$. The electroplating baths of the present invention may be used over a wide range of operating conditions since the brightening additives of the present invention can enhance the deposit of a ductile bright zinc plate over a wide range of pH, temperature and current density conditions. In addition, it is an advantage of the present invention that the brightening agents have a long working life and hence, baths of this invention can be economically employed.

Generally, the zinc plate will be electrodeposited from the zinc electroplating bath using an average cathode current density of from about 1 to 10,000 amp/ft$^2$ (ASF) with bath temperatures within the range of from about 50° F. to about 160° F. The maximum cathode current density applicable is dependent upon the particular type of zinc electrolyte employed. The bath may be agitated with air or agitated mechanically during plating or the workpieces may themselves be mechanically moved if such is desired. Alternatively, the plating solution may be pumped to create turbulence.

The zinc plate produced by the method of the present invention is normally ductile and bright. However, it will be appreciated that some platers may only desire a semi-bright zinc plate, making it possible to use only an amount of brightener effective to make a semi-bright zinc plate, thus economizing on the amount of brigthener employed.

ZINC-NICKEL AND/OR COBALT ELECTROPLATING BATH

Zinc alloy baths of the present invention can comprise any of the ingredients necessarily employed in zinc alloy electroplating baths. Zinc alloy electroplating baths of different types generally speaking contain zinc ions in combination with either nickel ions or cobalt ions or a mixture of nickel ions and cobalt ions to provide the desired zinc-nickel, zinc-cobalt or zinc-nickel-cobalt alloy deposit or plate upon electrodeposition.

Zinc ions, in accordance with conventional practice, can be introduced into the aqueous solution in the form of an aqueous soluble zinc salt, such as zinc sulfate, zinc chloride, zinc fluoroborate, zinc sulfamate, zinc acetate, or mixtures thereof to provide an operating zinc ion concentration ranging from about 15 g/l to about 225 g/l with concentrations of about 20 g/l up to 100 g/l being preferred. The nickel and/or cobalt ions, also in accordance with conventional practice, can be introduced into the aqueous solution in the form of the aqueous soluble salt of nickel or cobalt such as the chloride, sulfate, fluoborate, acetate, or sulfamate salts or mixtures thereof. Either, or a combination of both, nickel and cobalt ions can be used herein. To produce an alloy deposit containing about 0.1 percent to about 30 percent of each of nickel and/or cobalt, each should be employed in the bath in amounts of from about 0.5 g/l to about 120 g/l. Preferably, the alloy deposit contains from about 1 percent to about a total of 20 percent of both nickel and/or cobalt, and the bath contains nickel and/or cobalt ion in an amount of from about 4 g/l to about 85 g/l respectively.

Zinc alloy baths may also contain various other additives or agents. In some cases a particular additive or agent may be useful for more than one purpose. Examples of additional ingredients which may be employed in the zinc alloy baths include buffers and bath modifiers such as boric acid, acetic acid, ammonium sulfate, sodium acetate, ammonium chloride and the like. For chloride containing baths, carriers such as polyoxylated ethers such as alcohols, phenols, naphthols or acetylenic glycols may be added. Aromatic carbonyl compounds such as chlorobenzaldehyde, cinnamic acid, benzoic acid, or nicotinic acid may also be used to enhance leveling and brightness. Zinc alloy baths may also contain conductive salts, such as ammonium sulfate, ammonium chloride or bromide, ammonium fluoroborate, magnesium sulfate, sodium sulfate, and the like, to improve the conductivity of the bath. Additional supportive additives such as aluminum sulfate, polyacrylamides, thioureas, or the like may also be added to the bath to improve the crystal structure of the zinc alloy plate obtained and provide the desired appearance to the alloy deposit. Neutral baths may contain common chelating agents to keep the metal ions in solution. The preferred chelating agents are citric acid, gluconic acid, glucoheptanoic acid, tartaric acid as well as their alkali metal, ammonium, zinc, cobalt, or nickel salts. Also triethanolamine may be used. The quantities used should be enough to keep the metals in solution at pH 6–8.9.

The pH of the zinc alloy bath is preferably adjusted by employing an acid corresponding to the zinc salt used. Thus, depending upon the particular zinc salt in the bath, sulfuric acid, hydrochloric acid, fluoroboric acid, acetic acid, sulfamic acid, or the like, can be added to the bath to provide an operating pH of from about 0 up to about 6 for acid baths, preferably from about 0.5 up to about 5.5. For neutral baths of pH about 6–8.9, complexing agents have to be used and the pH can be adjusted via alkaline metal or ammonium hydroxides or carbonates.

It is also contemplated that the bath of the present invention can further incorporate controlled amounts of other compatible brightening agents of the types that could be employed in zinc alloy plating solutions. Included among such supplemental and optional brightening agents are aromatic carbonyl compounds, thioureas or N-substituted derivatives thereof, cyclic thioureas, polyacrylamides, and the like.

In addition, aluminum ion can be introduced into the bath by an aqueous soluble salt thereof, such as aluminum sulfate, to obtain an enhanced brightening effect. Aluminum ion can suitably be employed in a concentration of from about 0.5 mg/l up to about 200 mg/l, preferably from about 4 mg/l up to about 40 mg/l.

To further enhance the corrosion resistance of the alloy deposit, small amounts of trace metals which will codeposit with the zinc alloy may be added to the electrolyte. For example, soluble salts of chromium, titanium, tin, cadmium, or indium may be added to the bath in amounts of 5 mg/l to 4 g/l.

In addition to the foregoing bath ingredients, the zinc alloy plating bath contains an effective amount of the AB-type polyamide brightener or mixtures thereof present in the same concentrations as previously described in connection with the zinc electroplating bath including permissible variations of as low as about 0.1 mg/l under plating processes employing very low current density rates to as high as about 10 g/l employing very high current density rates.

In accordance with the method of the present invention, a zinc alloy deposit is electrodeposited from a zinc alloy electroplating bath comprising the above described brightening additive in an amount effective to obtain a desirable zinc alloy deposit. The process of zinc alloy plating of the present invention is useful for decorative or industrial zinc alloy plating such as strip plating, conduit plating, wire plating, rod plating, tube or coupling plating, and so forth. Each application will require a specific form of electrolyte to be used depending on what corrosion protection or properties are desired.

Zinc alloy plating baths of the present invention can be employed over a broad range of temperatures. In use, the temperature of operation of the bath is normally between about 60° F. and 160° F. and even up to 170° F. and typically, between 65° F. and 95° F.

The electrodeposition of zinc alloy from the bath can be carried out in the older conventional or newer high speed functional methods. The electroplating baths of the present invention may be used over a wide range of operating conditions since the brightening additives of the present invention can enhance the deposit of the semi-bright to bright zinc alloy plate over a wide range of pH, temperature and current density conditions. In addition, it is an advantage of the present invention that the brightening agents have a long working life and hence, baths of this invention can be economically employed.

Generally, the zinc alloy plate will be electrodeposited from the zinc alloy electroplating bath using an average cathode current density of from about 10 to 5,000 amp/ft$^2$ (ASF) with bath temperature within the range of from about 65° F. to about 160° F. The maximum cathode current density applicable is dependent upon the particular type of zinc alloy electrolyte employed. The bath may be agitated with air or agitated mechanically during plating or the workpieces may themselves be mechanically moved if such is desired. Alternatively, the plating solution may be pumped to create turbulence.

ZINC-IRON ALLOY ELECTROPLATING BATH

The AB-type polyamide brightener is also suitable for use in aqueous electroplating baths containing zinc ions and iron ions for electrodepositing a zinc-iron alloy as well as a bath further containing nickel ions or cobalt ions for electrodepositing a corresponding zinc-iron-nickel alloy or a zinc-iron-cobalt alloy. Beside the AB-type polyamide brightener, such alloy electroplating baths can contain any of the ingredients conventionally employed in accordance with prior art practices.

The iron ions can be introduced into the aqueous solution in the form of aqueous soluble iron salts, such as iron sulfate, iron chloride, iron fluoborate, iron sulfamate, iron acetate, or mixtures thereof to provide an operating iron ion concentration ranging from about 5 g/l up to about 140 g/l with concentrations of about 40 g/l up to about 100 g/l being preferred. The zinc ions as well as any nickel or cobalt ions can be introduced in the bath employing bath soluble and compatible salts of the types previously described in connection with the electroplating bath for depositing zinc-nickel and/or cobalt alloys.

To produce an alloy deposit containing about 5 percent to about 96 percent of zinc, the zinc ions should be employed in the bath in amounts of about 2 g/l to about 120 g/l. Preferably, the zinc-iron alloy deposit contains from about 10 percent to about 88 percent zinc and the bath preferably contains zinc ions at a concentration of from about 7 to about 75 g/l.

The electroplating bath may optionally but preferably, further contain buffering agents and conductivity salts of the types hereinbefore described.

The zinc-iron alloy electroplating bath can range in pH from about 0 up to about 6.5, preferably from about 0.5 to about 5. When the bath is weakly acidic or near neutral, such as at a pH of about 3 to about 6.5, it is preferred to incorporate conventional complexing or chelating agents to maintain an effective amount of the metal ions in solution. The preferred chelating or complexing agents are citric acid, gluconic acid, glucoheptanoic acid, tartaric acid, ascorbic acid, isoascorbic acid, malic acid, glutaric acid, muconic acid, glutamic acid, glycollic acid, aspartic acid, and the like as well as their alkali metal, ammonium, zinc or ferrous salts thereof. Additionally, suitable complexing or chelating agents that can be employed include nitrilo triacetic acid, ethylene diamine tetraethanol and ethylene diamine tetra acetic acid and salts thereof.

The presence of excessive amounts of ferric ions in the electroplating bath is objectionable due to the formation of striations in the plated surface. For this reason, it is desirable to control the ferric ion concentration at a level usually less than about 2 g/l. Although the iron constituent of the bath is normally introduced as ferrous ions, some oxidation of the ferrous ions to the ferric state occurs during the operation of the bath. It has been found that a control of the ferric iron formation to within acceptable levels is achieved by employing a soluble zinc anode in the electroplating bath or, alternatively, by immersing metallic zinc in the holding tank through which the electroplating solution is circulated. In the event no soluble anodes are employed in the electroplating proces or no zinc metal is provided in the holding tank, appropriate control of the ferric ion concentration can be achieved employing suitable bath soluble and compatible organic and/or inorganic reducing agents such as, for example, bisulfite, isoascorbic acid, monosaccharides and disaccharides such as glucose or lactose.

The bath can also optionally contain appropriate concentrations of nickel ions or cobalt ions to provide a ternary alloy of zinc-iron and nickel or zinc-iron-cobalt. The cobalt and nickel ions can be introduced as in the case of the zinc-nickel or zinc-cobalt alloys and their concentration is preferably controlled so as to provide an alloy containing from about 1 percent to about 20 percent of iron with either about 0.1 to about 2 percent cobalt or about 0.1 to about 20 percent by weight nickel and the balance essentially zinc.

In addition to the foregoing, the bath further contains the AB-type polyamide brightener at a concentration equivalent to that employed for plating zinc-cobalt or zinc-nickel alloys with a concentration of from about 0.01 up to about 2 g/l being preferred for most common purposes. Higher and lower concentrations as previously described can be employed in consideration of the plating process and the current densities employed.

In accordance with the process aspects of the present invention, the zinc-iron alloy or zinc-iron and nickel or cobalt alloy is deposited and has utility as an industrial or functional plating such as for strip plating, conduit plating, wire plating, rod plating, tube or coupling plating, electroforming build up of worn parts, plating of soldering iron tips, plating of Intaglio plates for printing or the like. Zinc-iron alloy plating baths generally operate at temperatures of about 60° to about 160° F. and preferably about 65° to about 95° F.

Generally, the zinc-iron alloy is electrodeposited using an average cathode current density of about 10 to about 5,000 ASF at bath temperatures of about 65° to about 160° F. The maximum cathode current density applicable is dependent upon the particular type of deposit desired. The bath is preferably agitated mechanically during the plating operation since air agitation has a tendency to increase the concentration of ferric ions in the bath.

In order to further illustrate the composition and process of the present invention, the following examples are provided. It will be understood that the examples are provided for illustrative purposes and are not intended to be limiting of the scope of the present invention as herein described and as set forth in the subjoined claims.

EXAMPLE 1

An aqueous electrolyte is prepared suitable for electrodepositing a zinc-nickel alloy containing 75 g/l of zinc sulfate monohydrate, 300 g/l of nickel sulfate hexahydrate, 3 percent by volume of concentrated sulfuric acid to provide a pH of about 0.4 and 50 mg/l of poly[N-(3-(N-pyrrolidonyl)propyl)aminopropionic acid] as the brightener. The bath is controlled at a temperature of about 125° to 134° F.

The electroplating bath is employed for electrodepositing a zinc-nickel plate on a rotating rod cathode of a diameter of ¼ inch providing a surface velocity of 300 feet per minute simulating high speed plating conditions. The average cathode current density is about 1000 ASF.

A uniform, semi-bright, satiny deposit of a thickness of about 0.3 to about 0.4 mil is produced having excellent adhesion and ductility. The alloy contained about 7.1 percent nickel.

EXAMPLE 2

An aqueous electrolyte is prepared suitable for electrodepositing a zinc-cobalt alloy containing 472.1 g/l zinc sulfate monohydrate, 56.5 g/l cobalt sulfate monohydrate and 1.8 percent by volume of concentrated sulfuric acid. As a brightener, 20 mg/l of poly[N-(3-(N-pyrrolidonyl)propyl)aminopropionic acid] is added to the bath. The electroplating bath is controlled at a temperature ranging from 110° to 120° F. and a rotating rod cathode as described in Example 1 is plated employing lead anodes at an average current density of 1,000 ASF producing a zinc-cobalt alloy of a silvery, semi-bright appearance having good ductility and acceptable adhesion containing 0.25 percent cobalt.

EXAMPLE 3

An aqueous electrolyte is prepared suitable for electrodepositing a zinc-iron alloy containing 130 g/l of zinc sulfate monohydrate, 370 g/l of ferrous sulfate heptahydrate, and the pH is adjusted to 2.0 employing sulfuric acid. As a brightener, 100 mg/l of poly[N-(3-(N-morpholinyl)propyl)aminopropionic acid] is added.

The temperature of the bath is controlled at 122° to 125° F. and a rotating rod cathode as previously described in Example 1 is plated utilizing zinc anodes at an average current density of 500 ASF. A zinc-iron alloy deposit is obtained of a very lustrous, semi-bright appearance which upon analysis contains 11.1 percent by weight iron.

EXAMPLE 4

An aqueous electrolyte is prepared suitable for depositing a zinc electrodeposit containing 200 g/l of zinc sulfate monohydrate, 15 g/l of ammonium sulfate, 25 g/l of boric acid and pH is adjusted to 4.2 employing sulfuric acid. As a brightener, 60 mg/l of poly[N-(3-(N-pyrrolidonyl)propyl)aminopropionic acid] is added. A test panel is immersed in the electrolyte which is controlled at a temperature of 81° F. and is electroplated employing air agitation utilizing a zinc anode at an average current density of 40 ASF. The plated test panel was fully bright and the plate was of good adhesion.

EXAMPLE 5

An aqueous electrolyte is prepared suitable for electrodepositing a zinc plate under simulated high speed plating conditions containing 500 g/l of zinc sulfate monohydrate, 3 percent by volume of concentrated sulfuric acid, and as a brightener, 40 mg/l of poly[N-(3-(N-morpholinyl)-propyl)aminopropionic acid]. The bath is controlled at a temperature of 81° to 90° F. and a rotating rod cathode as described in Example 1 rotating to provide a surface velocity of 180 feet per minute is electroplated employing a lead anode at a current density of 1,000 ASF. A fully bright zinc deposit with good adhesion is obtained.

EXAMPLE 6

An aqueous electrolyte is prepared suitable for depositing a zinc-iron-cobalt alloy containing 100 g/l of zinc sulfate monohydrate, 50 g/l of cobalt sulfate hexahydrate, 150 g/l of ferrous sulfate heptahydrate and as a brightener, 0.5 g/l of poly-N-[(N',N'dihydroxyethyl-N'-propyl)propionamide]. The bath is adjusted to a pH of 2 and a rotating cathode as described in Example 1 is plated providing an average surface speed of 300 feet per minute at a average current density of 1,000 ASF employing zinc anodes at a bath temperature of 120° F. A zinc alloy is obtained which upon analysis contains 6 percent by weight iron and 0.75 percent by weight cobalt.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. An aqueous bath suitable for electrodepositing zinc and zinc alloys on a conductive substrate comprising zinc ions present in an amount sufficient to electrodeposit zinc, and in the case of a zinc alloy, additional metal ions selected from the group consisting of nickel, cobalt and iron present in an amount to electrodeposit an alloy of zinc and nickel, zinc and cobalt, zinc, nickel and cobalt; zinc and iron, zinc, iron and nickel; zinc, iron and cobalt; and a brightening amount of a bath soluble AB polyamide brightener of the structural formula:

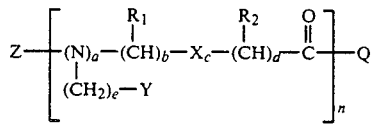

Z is —H, or

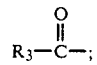

Q is —O—$R_4$, —$NR_5R_6$, or, —OM;

$R_1$ and $R_2$ are the same or different and are —H, —OH, an alkyl group of 1-4 carbons, an aryl group,

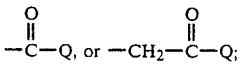

$R_3$ is

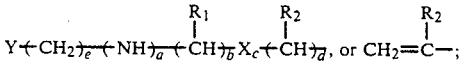

$R_4$, $R_5$ and $R_6$ are the same or different and are —H, or an alkyl, alkenyl, alkynyl, alkanol, alkenol, alkynol, keto alkyl, keto alkenyl, keto alkynyl, alkamine, alkoxy, polyalkoxyl, sulfoalkyl, carboxyalkyl, mercapto alkyl, or nitriloalkyl group having from 1 to about 12 carbon atoms, phenyl, or substituted phenyl, or,

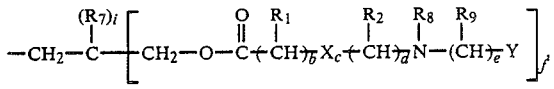

where f+i=3;

$R_7$ is —H, —OH, or a hydroxyalkyl group having from 1–4 carbons;

$R_8$ is —H, or an alkyl, alkanol, or alkamine group, having from 1–4 carbons, or

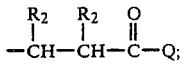

$R_9$, $R_{10}$ and $R_{11}$ are the same or different and are —H, or an alkyl group of 1–4 carbons;

$R_{12}$ is —H, or an alkanol, alkamine, sulfoalkyl, carboxyalkyl, hydroxyaryl, sulfoaryl, carboxyaryl, or aminoaryl having from 1 to about 10 carbons; or,

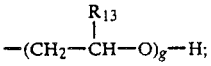

$R_{13}$ is —H, alkyl, alkenyl, or, alkynyl of 1–4 carbons or, $—CH_2—O—R_{14}$;

$R_{14}$ is —H, alkyl, alkenyl, or alkynyl of 1–4 carbons;

M is H, Li, Na, K, Be, Mg, or Ca;

X is

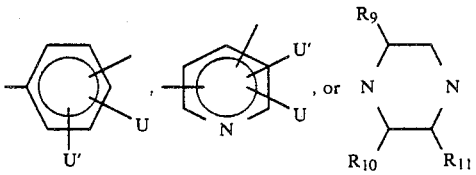

U and U' are the same or different and are H, Cl, Br, F, $—NO_2$, $—SO_3M$, or, $—O—R_4$;

Y is $—O—R_{12}$, $—N(R_{12})_2$, $—SO_3M$, $—CO_2M$, $—SR_{12}$, —CN, or, Y', except in the special case where:

b=c=0, and d=2, then Y is limited to being selected from the group defined for Y';

Y' is —H,

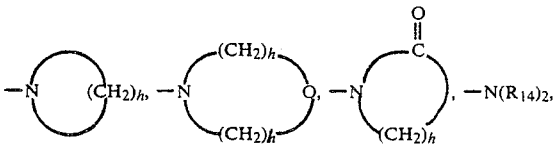

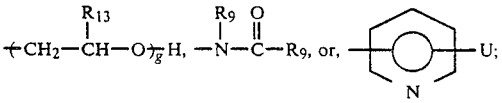

a is 0 or 1;

b is an integer from 0 to 11;

c is 0 or 1;

d is an integer from 0 to 2;

e is an integer from 0 to 6;

f is an integer from 1 to 3;

g is an integer from 1 to 30;

h is an integer from 2 to 5; and i is an integer from 0 to 2;

as well as mixtures thereof, wherein said constituents and the number thereof are selected so that the compound contains at least two amide groups.

2. The bath as defined in claim 1 in which said brightener is present in an amount of about 0.1 mg/l to about 10 g/l.

3. The bath as defined in claim 1 further including a buffering agent.

4. The bath as defined in claim 1 further including bath soluble and compatible conductive salts for increasing the electrical conductivity of said bath.

5. The bath as defined in claim 1 further including a complexing agent present in an amount sufficient to retain an effective amount of zinc ions and any other metal ions present for codeposition in solution.

6. The bath as defined in claim 1 in which said brightener is present in an amount of about 0.01 to about 2 g/l.

7. The bath as defined in claim 1 containing zinc ions present in an amount of about 4 to about 250 g/l.

8. The bath as defined in claim 1 containing zinc ions present in an amount of about 8 to about 165 g/l.

9. The bath as defined in claim 1 containing zinc ions in an amount of about 60 to about 165 g/l and further including hydrogen ions to provide a pH of about 0 to about 6.

10. The bath as defined in claim 1 containing zinc ions in an amount of about 30 to about 50 g/l and further including hydrogen ions and hydroxyl ions to provide a pH of about 6 to about 9.

11. The bath as defined in claim 10 further including a complexing agent present in an amount sufficient to retain an effective amount of zinc ions in solution.

12. The bath as defined in claim 1 containing zinc ions in an amount of about 8 to about 11 g/l and further including hydroxyl ions to provide a pH of about 9 to about 14.

13. The bath as defined in claim 1 containing zinc ions present in an amount of about 15 to about 225 g/l and at least one of nickel ions and cobalt ions present in an amount of about 0.5 to about 120 g/l.

14. The bath as defined in claim 13 further including hydrogen ions to provide a pH of about 0 to about 6.5.

15. The bath as defined in claim 13 further including hydrogen ions to provide a pH of about 0.5 to about 5.5.

16. The bath as defined in claim 13 further including hydrogen ions and hydroxyl ions to provide a pH of about 6 to about 8.9 and a complexing agent present in an amount sufficient to retain an effective amount of said zinc ions and said nickel and/or cobalt ions in solution.

17. The bath as defined in claim 1 containing zinc ions present in an amount of about 20 to about 100 g/l and at least one of nickel ions and cobalt ions present in an amount of about 4 to about 85 g/l.

18. The bath as defined in claim 1 containing zinc ions and iron ions and further containing hydrogen ions to provide a pH of about 0 to about 6.5.

19. The bath as defined in claim 18 containing hydrogen ions to provide a pH of about 0.5 to about 5.

20. The bath as defined in claim 18 containing hydrogen ions to provide a pH of about 3 to about 6.5 and further containing a complexing agent present in an amount sufficient to retain an effective amount of said zinc ions and said iron ions in solution.

21. The bath as defined in claim 18 containing about 5 to about 140 g/l iron ions.

22. The bath as defined in claim 18 containing about 40 to about 100 g/l iron ions.

23. The bath as defined in claim 18 containing about 2 to about 120 g/l of said zinc ions.

24. The bath as defined in claim 18 containing about 7 to about 75 g/l of said zinc ions.

25. The bath as defined in claim 1 containing nickel ions and iron ions in combination with zinc ions in an amount to provide an alloy electrodeposit containing about 0.1 percent to about 20 percent by weight nickel, about 1 to about 20 percent by weight iron and the balance essentially zinc.

26. The bath as defined in claim 1 containing cobalt ions and iron ions in combination with zinc ions in an amount to provide an alloy electrodeposit containing about 0.1 percent to about 2 percent by weight cobalt, about 1 percent to about 20 percent by weight iron and the balance essentially zinc.

27. A process for electrodepositing zinc and zinc alloys on a conductive substrate which comprises the steps of contacting a substrate with the aqueous bath as defined in claim 1 and electrodepositing zinc and zinc alloys on the substrate to a desired thickness.

* * * * *